US011250658B2

(12) United States Patent
Takeuchi et al.

(10) Patent No.: US 11,250,658 B2
(45) Date of Patent: Feb. 15, 2022

(54) COIN DIVERTER

(71) Applicant: GLORY LTD., Hyogo (JP)

(72) Inventors: Masato Takeuchi, Hyogo (JP); Eisei Nishida, Hyogo (JP)

(73) Assignee: GLORY, LTD., Hyogo (JP)

( * ) Notice: Subject to any disclaimer, the term of this patent is extended or adjusted under 35 U.S.C. 154(b) by 42 days.

(21) Appl. No.: 16/751,237

(22) Filed: Jan. 24, 2020

(65) Prior Publication Data

US 2020/0160643 A1 May 21, 2020

Related U.S. Application Data

(63) Continuation of application No. 15/988,222, filed on May 24, 2018, now Pat. No. 10,629,021.

(30) Foreign Application Priority Data

May 24, 2017 (JP) ..... JP2017-103083

(51) Int. Cl.
*G07D 3/12* (2006.01)
*G07D 3/14* (2006.01)
(Continued)

(52) U.S. Cl.
CPC ..... *G07D 3/14* (2013.01); *G07D 3/02* (2013.01); *G07D 3/125* (2013.01); *G07D 5/02* (2013.01); *G07D 9/008* (2013.01)

(58) Field of Classification Search
CPC ..... G07D 3/12; G07D 3/121; G07D 3/123; G07D 3/125; G07D 3/126; G07D 3/14;
(Continued)

(56) References Cited

U.S. PATENT DOCUMENTS 2,570,516 A * 10/1951 Bowman ..... G07F 11/32 221/253
4,503,961 A * 3/1985 Chittleborough ..... G07D 5/08 194/346
(Continued)

FOREIGN PATENT DOCUMENTS

DE 3718979 A1 12/1988
EP 0298814 A1 * 1/1989 ..... G07F 3/04
(Continued)

OTHER PUBLICATIONS

English Translation of EP 0 298 814 A1 (Year: 1989).*
Extended European Search Report for EP18173642.2 dated Sep. 28, 2018.

*Primary Examiner* — Jeffrey A Shapiro
(74) *Attorney, Agent, or Firm* — Brundidge & Stanger, P.C.

(57) ABSTRACT

There is provided a coin diverter that allows increase in the number of coin diversion directions and reduction in the size of a coin handling apparatus. The coin diverter includes a diverter member that diverts a coin from a transport path and a driver that changes the state of the diverter member to any of a first state in which the diverter member leads the coin toward the downstream side of the transport path, a second state in which the diverter member leads the coin in a first direction in which the coin drops from the transport path, and a third state in which the diverter member leads the coin in a second direction different from the direction toward the downstream side of the transport path and the first direction.

7 Claims, 14 Drawing Sheets

(51) Int. Cl.
*G07D 3/02* (2006.01)
*G07D 5/02* (2006.01)
*G07D 9/00* (2006.01)

(58) Field of Classification Search
CPC ..... G07D 3/02; G07D 5/02; G07D 9/008; G07D 3/04; B65H 29/60; B65H 31/24; B65H 2301/4217; B65H 2408/11; B65H 2408/111; B65H 2408/112; B65H 2405/33; B65H 29/58; B65H 2301/332; B65H 2404/63; B65H 2301/4455; B65H 2404/6591
USPC ..... 194/344, 346; 271/296–305
See application file for complete search history.

(56) References Cited

U.S. PATENT DOCUMENTS 4,666,027 A * 5/1987 Ostroski ..... G07D 5/08 193/DIG. 1
4,693,357 A * 9/1987 Aschenbeck ..... G07F 5/04 194/202
4,741,427 A * 5/1988 Choderker ..... G07D 5/04 194/335
4,860,877 A * 8/1989 Echapare Ibarrola ... G07D 3/14 194/346
4,971,188 A * 11/1990 Deters ..... G07D 3/14 194/337
5,255,770 A * 10/1993 Hird ..... G07F 1/041 194/345
5,915,519 A * 6/1999 Glaser ..... G07F 1/045 194/345
6,039,165 A * 3/2000 Wild ..... G07D 1/06 194/217
6,053,300 A * 4/2000 Wood ..... G07D 5/08 194/317
6,607,063 B2 * 8/2003 Kuwabara ..... G07D 1/06 194/346
6,644,456 B2 * 11/2003 Trenner ..... G07D 3/00 194/321
6,698,568 B2 * 3/2004 Nakajima ..... G07D 3/14 194/314
10,629,021 B2 * 4/2020 Takeuchi ..... G07D 5/02
2001/0040081 A1 * 11/2001 Smith ..... G07D 3/14 194/346
2002/0050438 A1 * 5/2002 Faes ..... G07F 1/047 194/207
2002/0153223 A1 * 10/2002 Nakajima ..... G07D 3/14 194/323
2002/0162725 A1 11/2002 Nakajima et al.
2004/0262122 A1 * 12/2004 Horian ..... G07F 1/047 194/247
2013/0090048 A1 * 4/2013 Fergusson ..... G07F 1/047 453/3

FOREIGN PATENT DOCUMENTS

EP 0840261 A1 5/1998
EP 1391850 A2 2/2004
GB 2228126 A * 1/1989 ..... G07F 9/00
GB 2252856 A 8/1992
JP H7249140 A 9/1995
JP H10228553 A 8/1998
JP 2006-236115 A 9/2006
JP 2016173633 A 9/2016

* cited by examiner

COIN DIVERTER

CROSS REFERENCE TO RELATED APPLICATIONS

This application is a Continuation under 35 U.S.C. § 120 of U.S. patent application Ser. No. 15/988,222, filed on May 24, 2018, which claims priority to Japanese Patent Application No. 2017-103083 filed on May 24, 2017. The disclosures of both applications are hereby incorporated herein by reference in their entireties.

TECHNICAL FIELD

The present invention relates to a coin diverter and a coin handling apparatus.

BACKGROUND ART

Conventionally, there is a coin handling apparatus that transports deposited coins in an inclining attitude, classifies the coins on a denomination basis, and stores the classified coins. The coin handling apparatus includes a coin diverter that diverts coins on a transport path in two directions, a coin transport direction and a direction toward the rear surface of each coin (surface supported by inclining transport path surface), and stores the coins classified on a denomination basis (see PTL 1, for example).

CITATION LIST

Patent Literature

PTL 1
Japanese Patent Application Laid-Open No. 2006-236115

SUMMARY OF INVENTION

Technical Problem

The coin diverter described in PTL 1, however, diverts the coins in the two directions, as described above. To divert the coins in three directions, two coin diverters need to be arranged, resulting in an increase in size of the apparatus.

An object of the present invention is to provide a technology for allowing increase in the number of coin diversion directions and reduction in the size of a coin handling apparatus.

Solution to Problem

A coin diverter according to the present invention includes a diverter member that diverts a coin from a transport path; and a driver that changes a state of the diverter member to any of a first state in which the diverter member leads the coin in a downstream direction of the transport path, a second state in which the diverter member leads the coin in a first direction in which the coin is dropped from the transport path, and a third state in which the diverter member leads the coin in a second direction different from the downstream direction of the transport path and the first direction.

A coin handling apparatus according to the present invention includes a diverter member that diverts a coin from a transport path; and a driver that changes a state of the diverter member to any of a first state in which the diverter member leads the coin in a downstream direction of the transport path, a second state in which the diverter member leads the coin in a first direction in which the coin is dropped from the transport path, and a third state in which the diverter member leads the coin in a second direction different from the downstream direction of the transport path and the first direction.

Advantageous Effects of Invention

The present invention allows increase in the number of coin diversion directions and reduction in the size of a coin handling apparatus.

DESCRIPTION OF EMBODIMENTS

Embodiments of the present invention will be described below with reference to the accompanying drawings.

Embodiment 1

Figure 1:
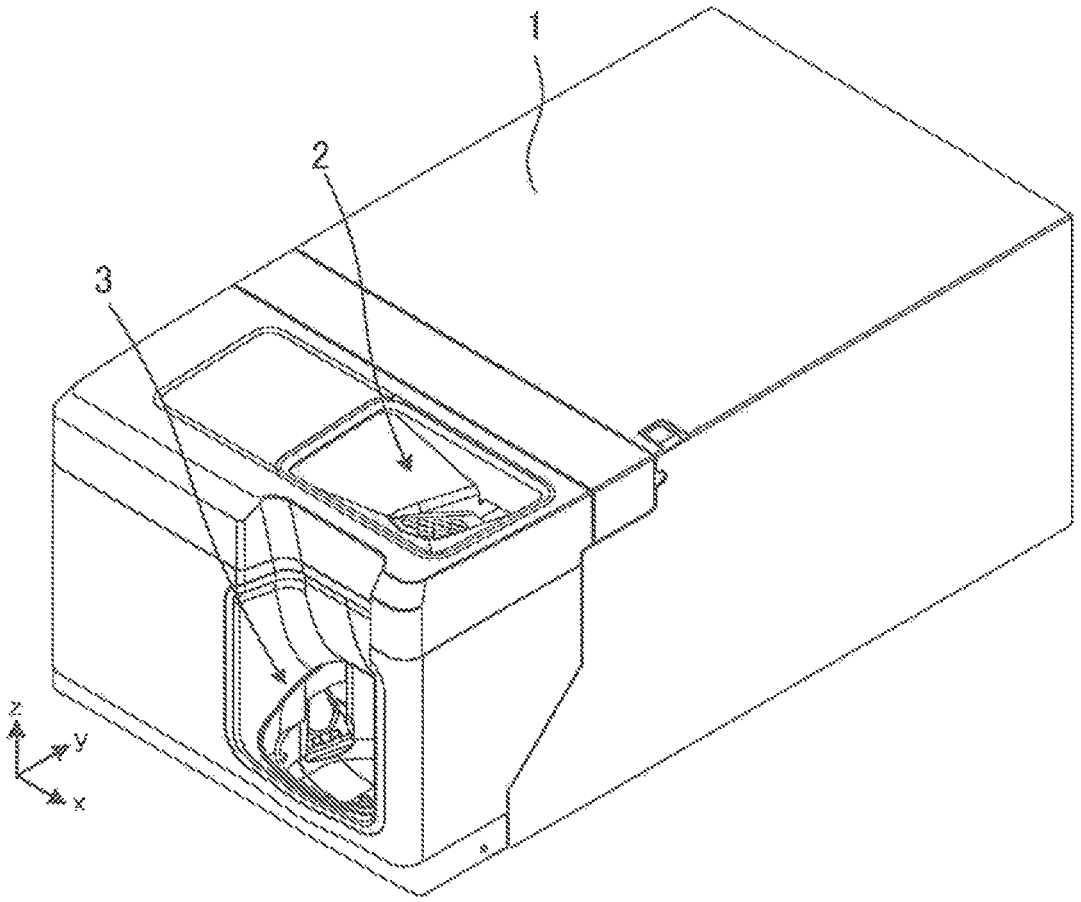
FIG. 1 is a perspective view showing an example of a coin handling apparatus that incorporates a coin diverter according to Embodiment 1.

FIG. 1 is a perspective view showing an example of a coin handling apparatus 1 that incorporates a coin diverter according to Embodiment 1. The coin handling apparatus 1 includes an inlet 2 and an outlet 3, as shown in FIG. 1. The coin handling apparatus 1, for example, stores coins paid at a register or feeds stored coins as changes. In the following description, a three-axis coordinate system, such as that shown in FIG. 1, is set in relation to the coin handling apparatus 1.

The inlet 2 is provided in a front upper surface of the apparatus. Coins to be deposited in the coin handling apparatus 1 are put into the inlet 2. The coins put into the inlet 2 are stored in the coin handling apparatus 1.

The outlet 3 is provided in the front surface of the apparatus and below the inlet 2. Coins stored in the coin handling apparatus 1 are withdrawn to the outlet 3. Coins rejected at the time of deposit are withdrawn to the outlet 3.

Figure 2:
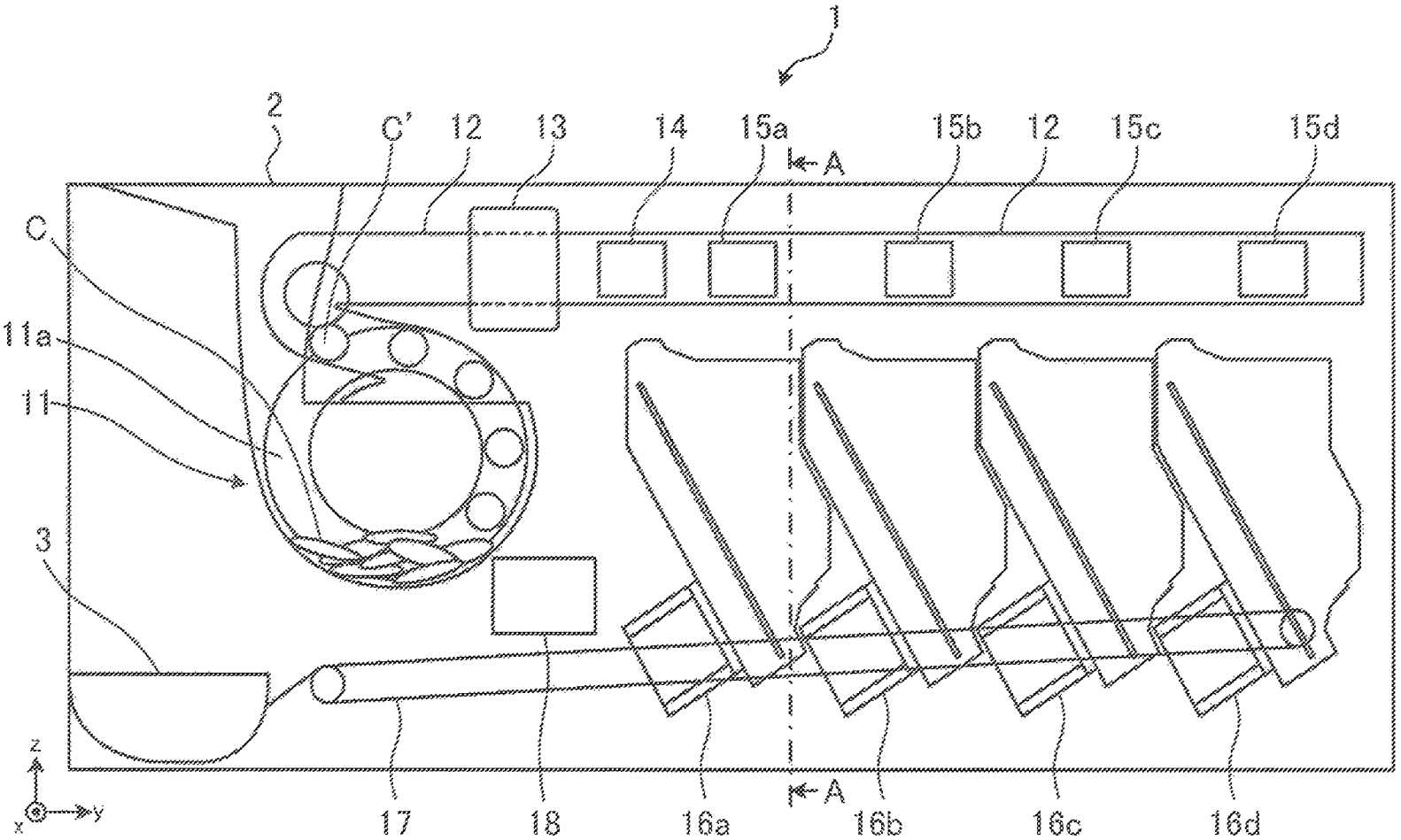
FIG. 2 is a side cross-sectional view of the coin handling apparatus.

FIG. 2 is a side cross-sectional view of the coin handling apparatus 1. The coin handling apparatus 1 shown in FIG. 2 is a simplified version of the coin handling apparatus 1 shown in FIG. 1 in terms of the shape and other factors. In FIG. 2, the same portions as those in FIG. 1 have the same reference characters.

The coin handling apparatus 1 includes an accumulating/feeding unit 11, a transport unit 12, an identifying unit 13, coin diverters 14 and 15*a* to 15*d*, storing/feeding units 16*a* to 16*d*, a withdrawal transport unit 17, and a collection box 18, as shown in FIG. 2.

Coins put into the inlet 2 travel along a chute and drop into the accumulating/feeding unit 11. The accumulating/feeding unit 11 temporarily accumulates the coins put into the inlet 2. Coins C shown in FIG. 2 represent the coins temporarily accumulated in the accumulating/feeding unit 11.

The accumulating/feeding unit 11 includes an inclining disk 11*a*. The inclining disk 11*a* has coin catching protrusions (not shown) on the front surface thereof. The accumulating/feeding unit 11 rotates the inclining disk 11*a* (counterclockwise in FIG. 2, for example) to allow the protrusions on the front surface thereof to catch the temporarily accumulated coins C and pick them up. The accumulating/feeding unit 11 then feeds the coins C picked up by the inclining disk 11*a* onto the transport unit 12. A coin C' shown in FIG. 2 represents a coin being fed by the inclining disk 11*a* onto the transport unit 12.

The transport unit 12 is provided immediately below the upper surface of the coin handling apparatus 1. The transport unit 12 is provided in a roughly central portion (roughly at the center in the x-axis direction, see FIG. 3, for example) when viewed from the side facing the front surface or the rear surface of the apparatus. The transport unit 12 extends from the front side toward the rear side of the apparatus. The transport unit 12 transports the coins fed from the accumulating/feeding unit 11 from the front side toward the rear side of the apparatus.

The identifying unit 13 is provided on the downstream side of the accumulating/feeding unit 11 but on the upstream side of the coin diverters 14 and 15*a* to 15*d* and on the transport unit 12. The identifying unit 13 identifies the coins fed from the accumulating/feeding unit 11. For example, the identifying unit 13 includes a variety of sensors, such as a magnetism sensor, and identifies the denomination of a coin transported by the transport unit 12 to be, for example, an accepted coin, a rejected coin, or a collected coin.

The coin diverter 14 diverts the coins transported by the transport unit 12 in three directions. For example, the coin diverter 14 diverts the coins transported by the transport unit 12 in a downstream transport direction (direction in which coins are directly transported by transport unit 12 (+y-axis direction)), the direction leading to the withdrawal transport unit 17, and the direction leading to the collection box 18.

The coin diverter 14 diverts the coins transported by the transport unit 12 in the three directions in accordance with the result of the identification performed by the identifying unit 13. For example, the coin diverter 14 diverts a coin identified by the identifying unit 13 to be a rejected coin in the direction leading to the withdrawal transport unit 17. A rejected coin includes a coin of a denomination that cannot be accepted as a deposited coin, a coin of a denomination that has not been successfully identified, and a counterfeit coin or a coin suspected thereof. The coin diverter 14 diverts coins having been identified by the identifying unit 13 to be collected coins in the direction leading to the collection box 18. A collected coin includes a coin of a denomination accepted as a deposited coin but not used as a withdrawn coin. Among rejected coins, counterfeit coins or coins suspected thereof may be stored in the collection box 18. The coin diverter 14 diverts coins which have been identified by the identifying unit 13 not to be rejected coins or collected coins and the denomination of which has been determined in the downstream transport direction.

The coin diverters 15*a* to 15*d* each divert the coins transported by the transport unit 12 in three directions. For example, the coin diverters 15*a* to 15*d* each divert the coins transported by the transport unit 12 in the downstream transport direction, in the direction leading to the storing/feeding units 16*a* to 16*d*, and the direction leading to four storing/feeding units (see FIG. 3, for example) so provided as to face the storing/feeding units 16*a* to 16*d* via the transport unit 12.

The coin diverters 15*a* to 15*d* each divert the coins transported by the transport unit 12 in the three directions in accordance with the result of the identification performed by the identifying unit 13. For example, the coin diverter 15*a* diverts a coin having been identified by the identifying unit 13 to be a coin of a first denomination in the direction leading to the storing/feeding unit 16*a* (see arrow A11 in FIG. 5, for example). The coin diverter 15*a* diverts a coin having been identified by the identifying unit 13 to be a coin of a second denomination in the direction leading to the storing/feeding unit so provided as to face the storing/feeding unit 16*a* via the transport unit 12 (see arrow A12 in FIG. 5, for example). The coin diverter 15*a* diverts a coin having been identified by the identifying unit 13 to be a coin of a denomination other than the first and second denominations in the downstream transport direction (+y-axis direction in FIG. 5, for example).

The coin diverter 15*b* diverts a coin having been identified by the identifying unit 13 to be a coin of a third denomination in the direction leading to the storing/feeding unit 16*b*. The coin diverter 15*b* diverts a coin having been identified by the identifying unit 13 to be a coin of a fourth denomination in the direction leading to the storing/feeding unit so provided as to face the storing/feeding unit 16*b* via the transport unit 12. The coin diverter 15*b* diverts a coin having been identified by the identifying unit 13 to be a coin of a denomination other than the first to fourth denominations in the downstream transport direction.

The coin diverter 15*c* also diverts the coins transported by the transport unit 12 in three directions, as do the coin diverters 15*a* and 15*b*. The coin diverter 15*d* diverts the coins in two directions because there is no apparatus on the downstream side of the transport unit 12. For example, the coin diverter 15*d* diverts the coins transported by the transport unit 12 in the following two directions; the direction leading to the storing/feeding unit 16*d*; and the direction leading to the storing/feeding unit so provided as to face the storing/feeding unit 16*d* via the transport unit 12.

The storing/feeding units 16*a* to 16*d* each store the coins transported by the transport unit 12. The coins transported by the transport unit 12 are diverted (sorted) by the coin diverters 15*a* to 15*d* in accordance with the result of the identification performed by the identifying unit 13. The storing/feeding units 16*a* to 16*d* each thus store coins on a denomination basis.

The coin handling apparatus 1 includes four storing/feeding units that face the storing/feeding units 16*a* to 16*d* via the transport unit 12, as described above. The coin handling apparatus 1 therefore stores coins of eight denominations at the maximum.

The storing/feeding units 16*a* to 16*d* (including storing/feeding units so provided as to face storing/feeding units 16*a* to 16*d* via transport unit 12) each feed stored coins onto the withdrawal transport unit 17. The storing/feeding units 16*a* to 16*d* each have an inclining disk having coin catching protrusions provided on the surface thereof. The storing/feeding units 16*a* to 16*d* each rotate the inclining disk to allow the protrusions on the front surface thereof to catch coins and pick the coins up. The storing/feeding units 16*a* to 16*d* each feed the coins picked up by the inclining disk via a feeding exit and drop the coins onto the withdrawal transport unit 17 (see arrow A in FIG. 3, for example).

The withdrawal transport unit 17 is provided above the bottom surface of the coin handling apparatus 1 and extends from the front side toward the rear side of the apparatus. Rejected coins diverted by the coin diverter 14 drop onto the withdrawal transport unit 17. Coins fed from the storing/feeding units 16*a* to 16*d* (including storing/feeding units so provided as to face storing/feeding units 16*a* to 16*d* via transport unit 12) also drop onto the withdrawal transport unit 17. The withdrawal transport unit 17 transports the rejected coins diverted by the coin diverter 14 and the coins fed from the storing/feeding units 16*a* to 16*d* to the outlet 3.

The collection box 18 stores collected coins diverted by the coin diverter 14. The collection box 18 is a box having no feeding function but dedicated to storage. The collected coins stored in the collection box 18 can be extracted by accessing the interior of the coin handling apparatus 1. Instead, the collection box 18 may have a removable cassette structure. The collection box 18 is provided below the transport unit 12 but above the withdrawal transport unit 17. Providing the collection box 18 in a front portion of the coin handling apparatus 1, specifically, in front of the storing/feeding unit 16*aa* allows the collected coins to be readily extracted.

Figure 3:
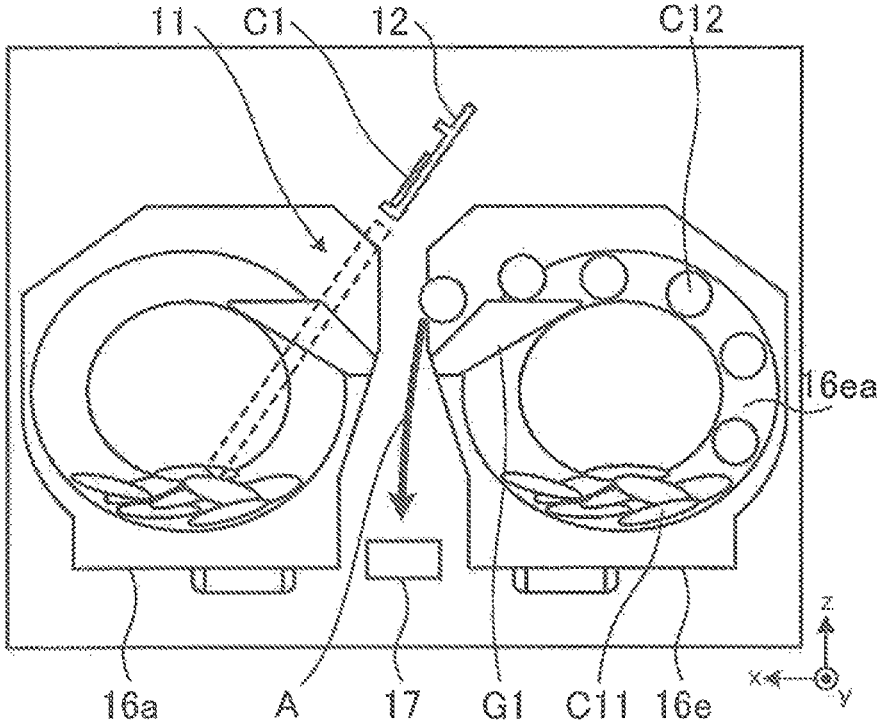
FIG. 3 is a cross-sectional view taken along the line A-A indicated by the arrows in FIG. 2.

FIG. 3 is a cross-sectional view taken along the line A-A in FIG. 2. In FIG. 3, the same portions as those in FIG. 2 have the same reference characters. In FIG. 3, part of the components shown in FIG. 2 is omitted.

The dotted line shown in FIG. 3 represents the inclining disk 11*a* of the accumulating/feeding unit 11. FIG. 3 also shows a coin C1 transported by the transport unit 12. A transport path of the transport unit 12, which transports the coin C1, inclines, as shown in FIG. 3.

The coin handling apparatus 1 includes a storing/feeding unit 16*e*, as shown in FIG. 3. The storing/feeding unit 16*e* is so provided as to face the storing/feeding unit 16*a* via the transport unit 12.

The coin handling apparatus 1 also includes storing/feeding feeding units that face the storing/feeding units 16*b* to 16*d* via the transport unit 12.

Coins C11 shown in FIG. 3 represent coins stored in the storing/feeding unit 16*e*. A coin C12 shown in FIG. 3 represents a coin to be fed from the storing/feeding unit 16*e*. The coin C12 is caught and picked up by a protrusion (not shown) on an inclining disk 16*ea*, which is provided in the storing/feeding unit 16*e*. The coin C12 then mounts on a guide G1, therefore separates from the inclining disk, and drops onto the withdrawal transport unit 17, as indicated by the arrow A in FIG. 3.

Figure 4:
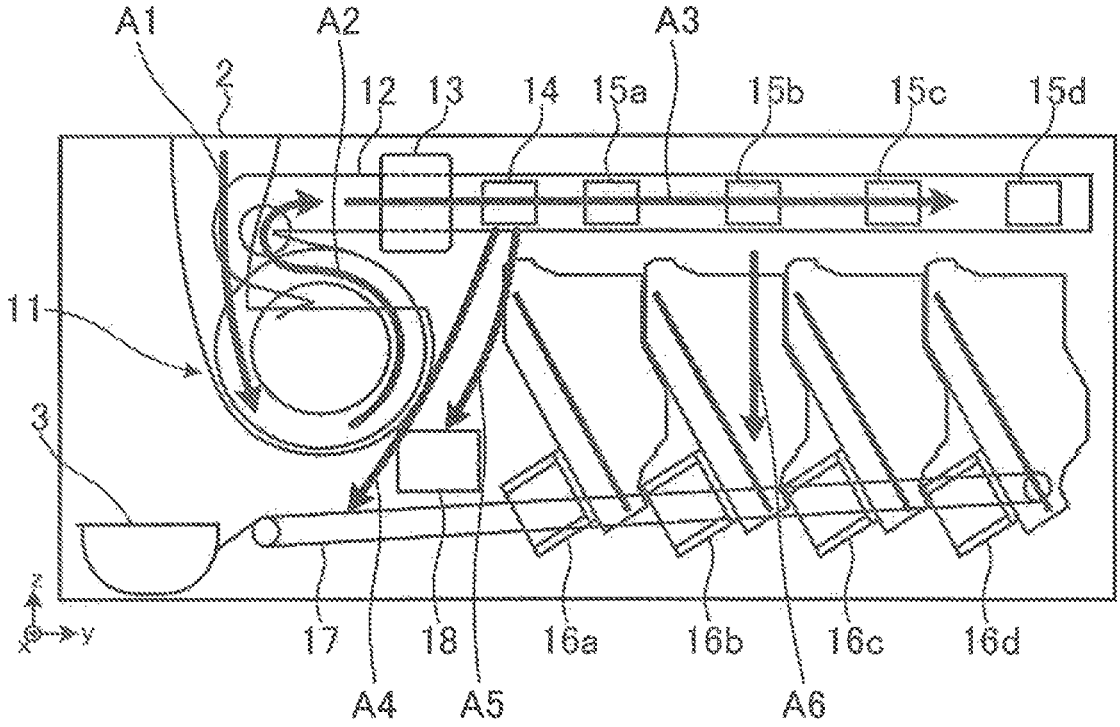
FIG. 4 is a first diagram for describing a coin transport path.

FIG. 4 is a first diagram for describing a coin transport path. In FIG. 4, the same portions as those in FIG. 2 have the same reference characters.

Coins put into the inlet 2 are sent to and temporarily accumulated in the accumulating/feeding unit 11, as indicated by the arrow A1.

The coins accumulated in the accumulating/feeding unit 11 are fed by the inclining disk 11*a* of the accumulating/feeding unit 11 onto the transport unit 12, as indicated by the arrow A2. The coins fed onto the transport unit 12 are transported downstream (in +y-axis direction), as indicated by the arrow A3.

Out of the coins transported by the transport unit 12, rejected coins are diverted by the coin diverter 14 from the transport unit 12 and dropped onto the withdrawal transport unit 17, as indicated by the arrow A4. The rejected coins are thus returned to the outlet 3. Out of the coins transported by the transport unit 12, collected coins are diverted by the coin diverter 14 from the transport unit 12 and dropped into the collection box 18, as indicated by the arrow A5. The collected coins are thus collected (stored) in the collection box 18.

Out of the coins transported by the transport unit 12, coins of identified denominations are diverted from the transport unit 12 by the coin diverters 15*a* to 15*d* corresponding to predetermined denominations and dropped into the storing/feeding units 16*a* to 16*d*. For example, coins of the denomination corresponding to the storing/feeding unit 16*b* are diverted from the transport unit 12 by the coin diverter 15*b* and dropped into the storing/feeding unit 16*b*, as indicated by the arrow A6.

Figure 5:
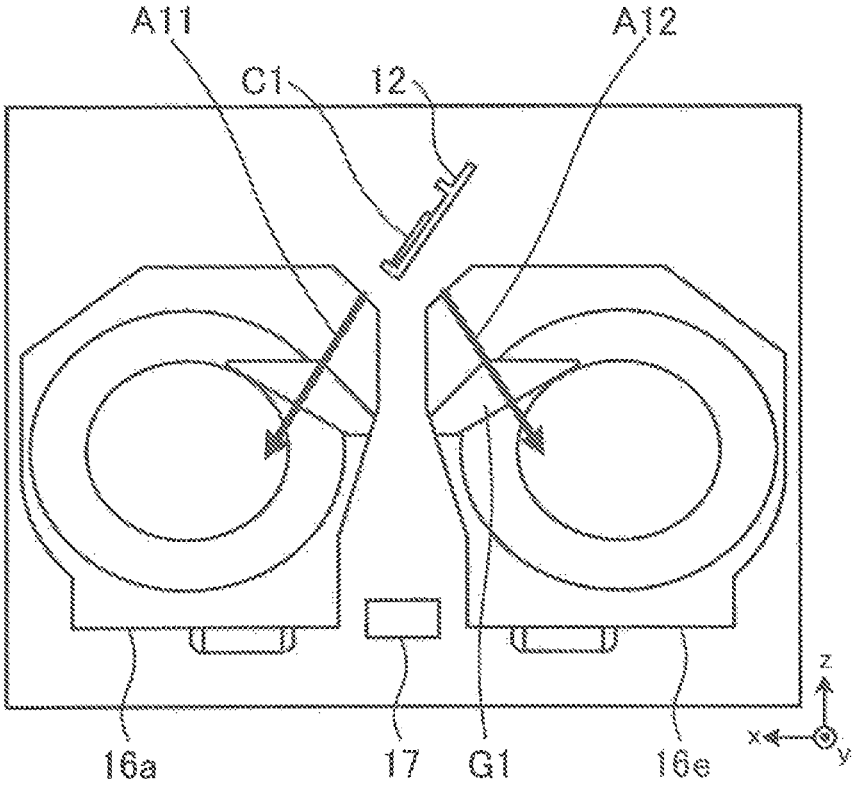
FIG. 5 is a second diagram for describing a coin transport path.

FIG. 5 is a second diagram for describing the coin transport path. In FIG. 5, the same portions as those in FIG. 3 have the same reference characters.

The direction in which the coins are transported by the transport unit 12 is diverted in accordance with the result of the identification performed by the identifying unit 13.

For example, the coin diverter 15*a* (not shown in FIG. 5) diverts the coin C1 transported by the transport unit 12 to one of the directions indicated by the arrows A11 and A12 in FIG. 5 in accordance with the result of the identification performed by the identifying unit 13. More specifically, in a case where the identifying unit 13 identifies the coin C1 to be a coin of a first denomination, the coin diverter 15*a* diverts the coin C1 in the direction indicated by the arrow A11. In a case where the identifying unit 13 identifies the coin C1 to be a coin of a second denomination, the coin diverter 15*a* diverts the coin C1 in the direction indicated by the arrow A12.

The coin diverter 15*a* diverts the coin C1 transported by the transport unit 12 in the +y-axis direction (transports coin C1 in downstream transport direction with no change in transport direction) in accordance with the result of the identification performed by the identifying unit 13. More specifically, in a case where the identifying unit 13 identifies the coin C1 to be a coin of a denomination other than the first and second denominations, the coin diverter 15*a* diverts the coin C1 in the downstream transport direction.

Figure 6:
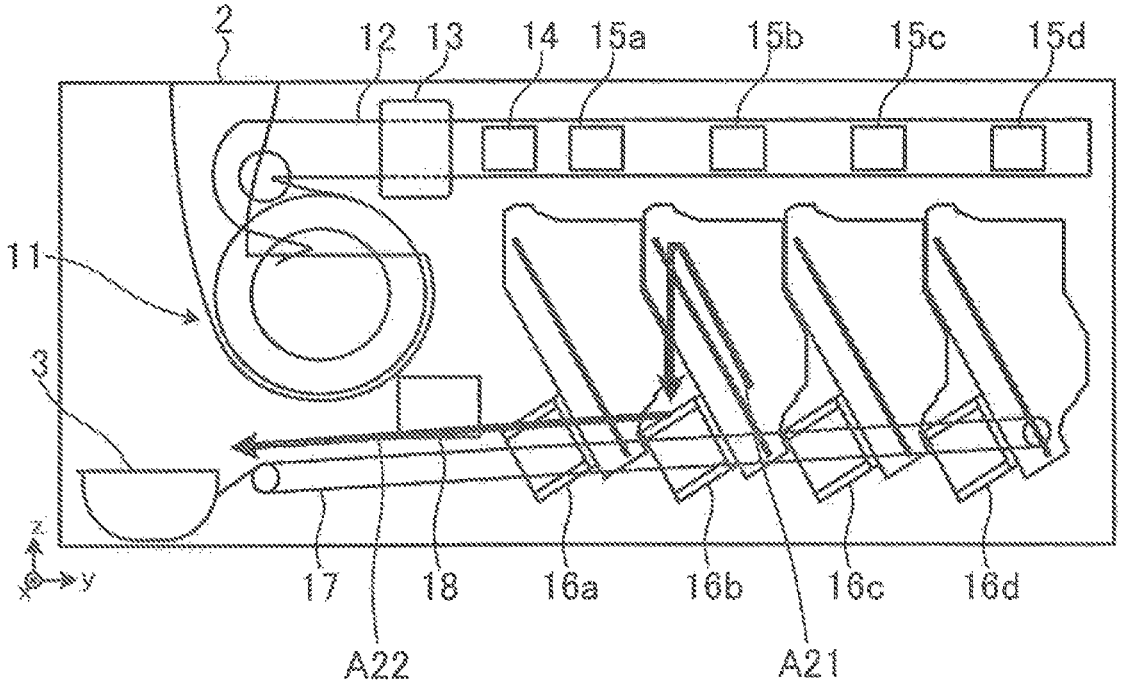
FIG. 6 is a third diagram for describing a coin transport path.

FIG. 6 is a third diagram for describing the coin transport path. The coins stored in the storing/feeding units 16*a* to 16*e* are picked up by the inclining disks provided in the storing/feeding units 16*a* to 16*e* (see coin C12 in FIG. 3, for example) and dropped onto the withdrawal transport unit 17. For example, the coins stored in the storing/feeding unit 16*b* are picked up by the inclining disk and dropped onto the withdrawal transport unit 17, as indicated by the arrow A21.

The coins dropped onto the withdrawal transport unit 17 are transported by the withdrawal transport unit 17 to the outlet 3, as indicated by the arrow A22. The coins stored in the storing/feeding units 16*a* to 16*e* are thus withdrawn via the outlet 3.

Figure 7:
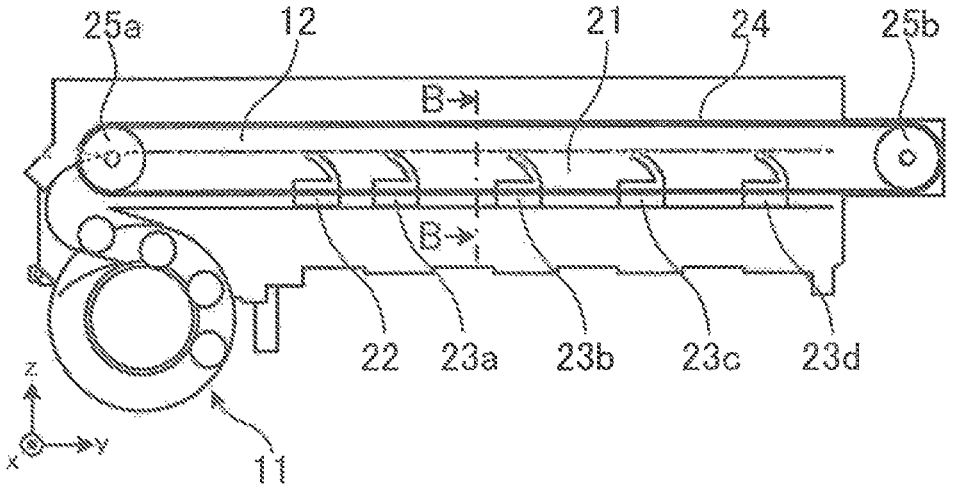
FIG. 7 describes a transport unit.

FIG. 7 describes the transport unit 12. In FIG. 7, the same portions as those in FIG. 2 have the same reference characters.

The transport unit 12 includes a transport path 21, which transports coins, as shown in FIG. 7. Opening sections 22, 23*a* to 23*d* are formed in the transport path 21. The opening sections 22, 23*a* to 23*d* each have a rectangular portion and an arcuate portion. The coin diverters 14 and 15*a* to 15*d*, which divert the coin transport direction, are provided (disposed) in the opening sections 22, 23*a* to 23*d*, as will be described later in detail.

The transport unit 12 includes a transport belt 24 and pulleys 25*a* and 25*b*, which drive (rotate) the transport belt 24. The transport belt 24 has a plurality of protrusions (not shown in FIG. 7) for catching the coins on the transport path 21.

Figure 8:
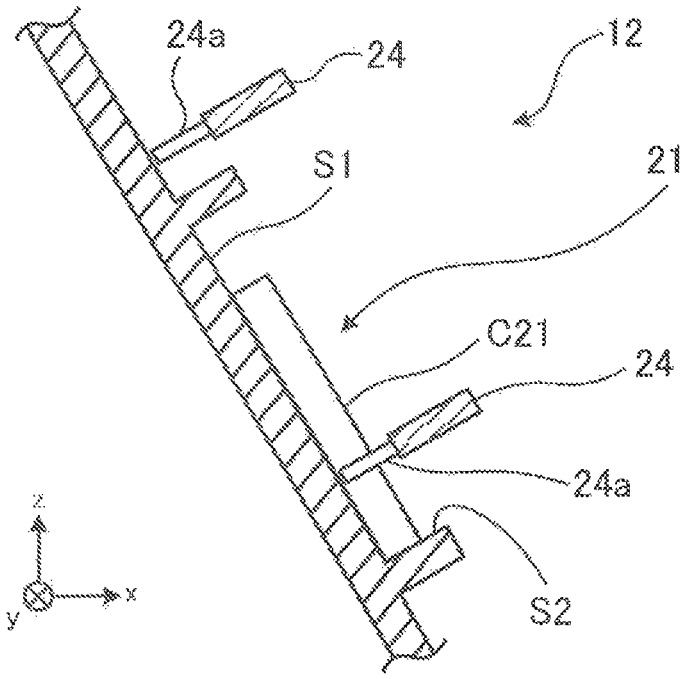
FIG. 8 is a cross-sectional view taken along the line B-B indicated by the arrows in FIG. 7.

FIG. 8 is a cross-sectional view taken along the line B-B indicated by the arrows in FIG. 7. In FIG. 8, the same portions as those in FIG. 7 have the same reference characters. FIG. 8 also shows a coin C21 transported by the transport unit 12.

The transport path 21 is formed of an inclining side surface S1 and a bottom surface S2, as shown in FIG. 8. The coin C21 is so supported that a flat surface (side surface) of the coin C21 is supported by the side surface S1 of the transport path 21 and the lower end of the circumferential surface of the coin C21 is supported by the bottom surface S2.

The transport belt 24 is so provided as to face the side surface S1 of the transport path 21. The transport belt 24 has protrusions 24*a*. The protrusions 24*a* each have one end extending to a point close to the side surface S1 of the transport path 21.

The transport belt 24 rotates counterclockwise in FIG. 7. A protrusion 24*a* provided on the transport belt 24 therefore pushes the rear side of the coin C21. The coin C21 is thus transported in the +y-axis direction.

The coin diverter 15*a* will be described. The coin diverters 14 and 15*b* to 15*d* have the same configuration as that of the coin diverter 15*a* and will not described below.

Figure 9:
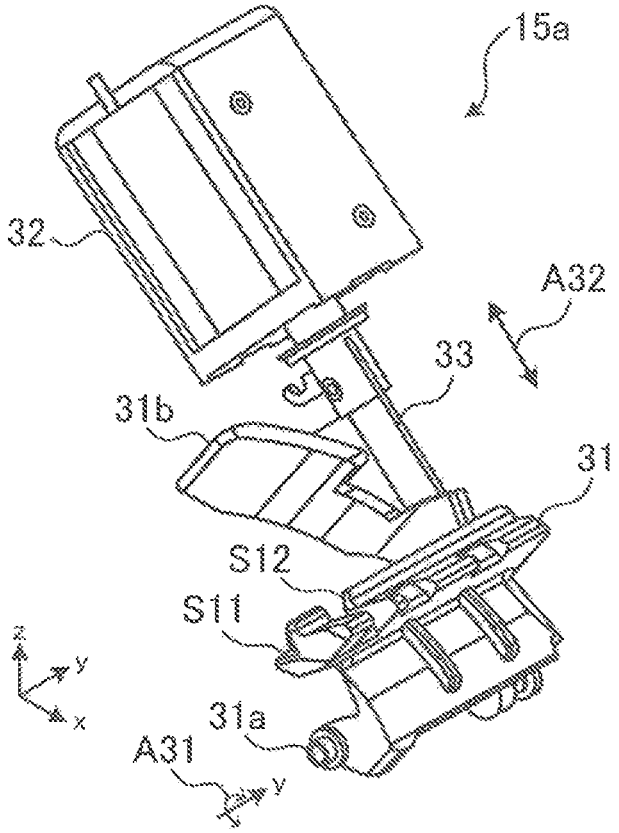
FIG. 9 is a perspective view of parts the form the coin diverter.
Figure 10:
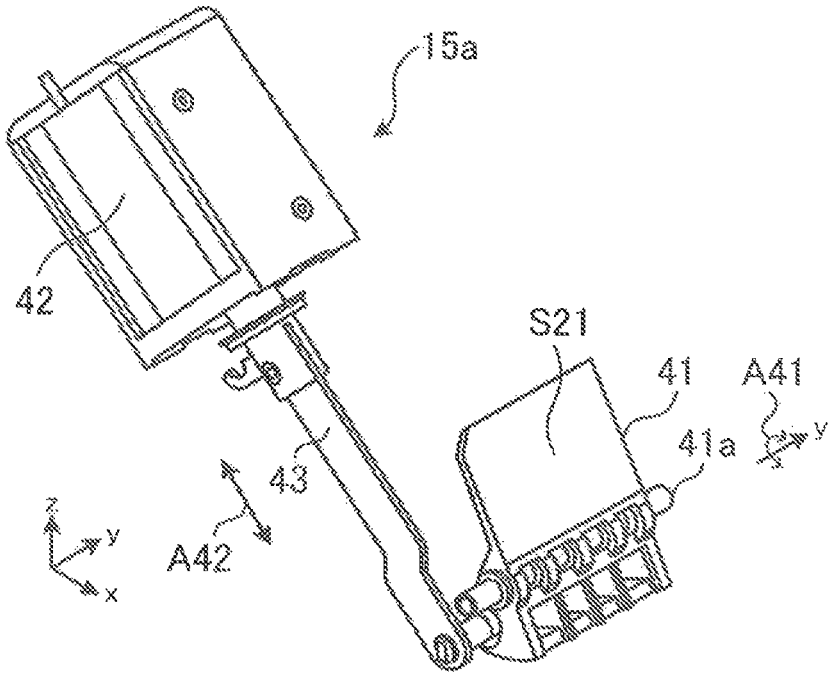
FIG. 10 is a perspective view of parts that form the coin diverter.

FIG. 9 is a perspective view of parts that form the coin diverter 15*a*. The coin diverter 15*a* is formed of the parts shown in FIG. 9 and the parts shown in FIG. 10, which will be described later (see FIG. 11, for example). The coin diverter 15*a* shown in FIGS. 9 and 10 is disposed in the opening section 23*a* of the transport unit 12 shown in FIG. 7 (or see FIG. 11).

The coin diverter 15*a* includes an A gate 31 (diverter member), an actuator 32 (driver), and a linkage member 33, as shown in FIG. 9.

The A gate 31 has a bottom surface S11 and a side surface S12. The bottom surface S11 and the side surface S12 form an L-letter-shaped surface. The lower end of the circumferential surface of a coin comes into contact with (mounts on) the bottom surface S11. The bottom surface S11 and the side surface S12 form part of the transport path 21 in the opening section 23*a* shown in FIG. 7, as will also be described below.

The A gate 31 pivots around a shaft 31*a*, which extends in the y-axis direction and serves as the axis of pivotal motion. The A gate 31 pivots around the shaft 31*a* clockwise and counterclockwise, as indicated by the double-headed arrow A31 shown in FIG. 9.

The A gate 31 includes a guide 31*b*. The guide 31*b* has an arcuate shape and is disposed along the arcuate portion of the opening section 23*a* shown in FIG. 7.

One end of the linkage member 33 is connected to the actuator 32. The actuator 32 linearly moves the linkage member 33 in the direction indicated by the double-headed arrow A32 in FIG. 9. The other end of the linkage member 33 is connected to the A gate 31 and linearly moves to cause the A gate 31 to pivot in the direction indicated by the double-headed arrow A31.

FIG. 10 is a perspective view of parts that form the coin diverter 15*a*. The coin diverter 15*a* includes a B gate 41 (diverter member), an actuator 42 (driver), and a linkage member 43, as shown in FIG. 10.

The B gate 41 has a side surface S21. One of the flat surfaces of a coin comes into contact with (mounts on) the side surface S21. The side surface S21 forms part of the transport path 21 in the opening section 23*a* shown in FIG. 7, as will be described below.

The B gate 41 pivots around a shaft 41*a*, which extends in the y-axis direction and serves as the axis of pivotal motion. The B gate 41 pivots around the shaft 41*a* clockwise and counterclockwise, as indicated by the double-headed arrow A41 shown in FIG. 10.

One end of the linkage member 43 is connected to the actuator 42. The actuator 42 linearly moves the linkage member 43 in the direction indicated by the double-headed arrow A42 in FIG. 9. The other end of the linkage member 43 is connected to the B gate 41 and linearly moves to cause the B gate 41 to pivot in the direction indicated by the double-headed arrow A41.

Figure 11:
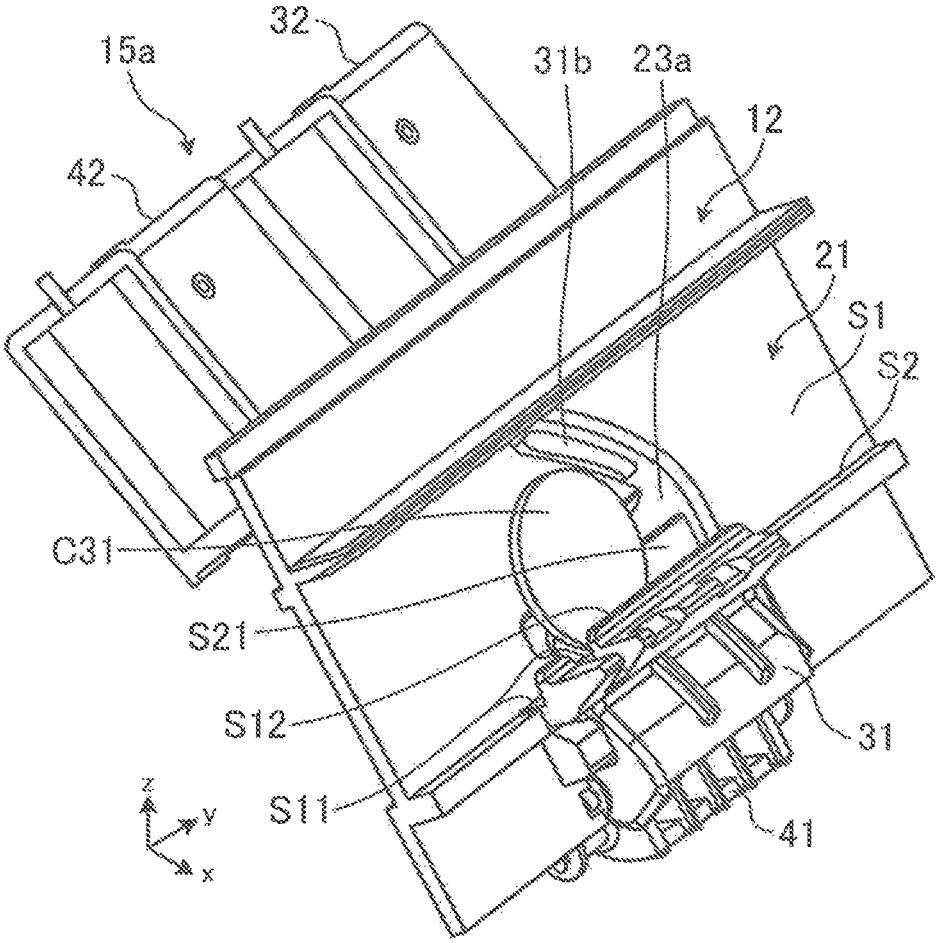
FIG. 11 is a first perspective view of the coin diverter attached to the transport unit.

FIG. 11 is a first perspective view of the coin diverter 15*a* attached to the transport unit 12. FIG. 11 shows the coin diverter 15*a* shown in FIGS. 9 and 10 and part of the transport unit 12 shown in FIGS. 7 and 8. In FIG. 11, the same portions as those in FIGS. 7 to 10 have the same reference characters. FIG. 11 shows a coin C31.

The A gate 31 and the B gate 41 are provided in the opening section 23*a* provided in the transport path 21, as shown in FIG. 11. The A gate 31 is so provided that the arcuate guide 31*b* is located along the arcuate portion of the opening section 23*a*.

In FIG. 11, the bottom surface S11 of the A gate 31 is flush with a bottom surface S2 of the transport path 21. The side surface S12 of the A gate 31 faces the side surface S1 of the transport path 21. The side surface S21 of the B gate 41 is flush with the side surface S1 of the transport path 21. That is, the bottom surface S11 and the side surface S12 of the A gate 31 and the side surface S21 of the B gate 41 form a U-letter-shaped transport path in the opening section 23*a* in the state shown in FIG. 11.

The coin C31 is therefore so transported as to pass the opening section 23*a* and travel toward the downstream side of the transport path 21 (in +y-axis direction). The coin C31 is therefore not led in the direction indicated, for example, by the arrow A11 or A12 shown in FIG. 5 or stored in the storing/feeding unit 16*a* or 16*e*.

Figure 12:
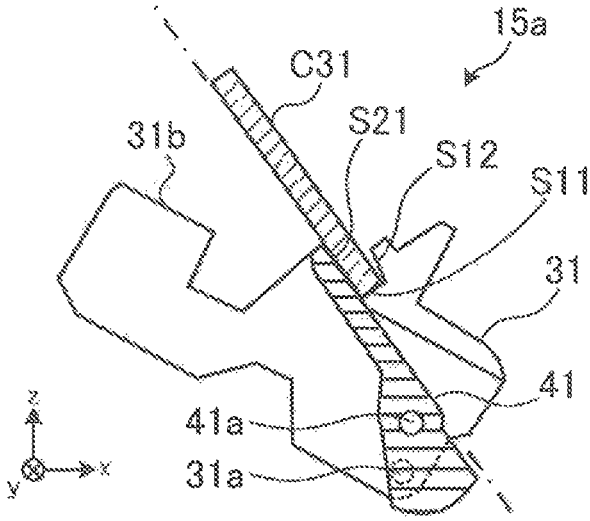
FIG. 12 shows the coin diverter in the state in FIG. 11 viewed along the −y-axis direction.

FIG. 12 shows the coin diverter 15*a* in the state in FIG. 11 viewed along the −y-axis direction. In FIG. 12, the same portions as those in FIGS. 9 to 11 have the same reference characters. In FIG. 12, the actuators 32 and 42 and the linkage members 33 and 43 are omitted. The coin diverter 15*a* shown in FIG. 12 is simplified in terms of shape and other factors, as compared with the coin diverter 15*a* shown in FIG. 11. The chain line shown in FIG. 12 represents the position of the side surface S1 of the transport path 21 shown in FIG. 11.

In the state shown in FIG. 12, in which the A gate 31 and the B gate 41 have pivoted under the control of the actuators 32 and 42, the bottom surface S11 of the A gate 31, the side surface S21 of the A gate 31, and the side surface S21 of the B gate 41 form a transport path which is located in the opening section 23*a* provided in the transport path 21 and along which the coin C31 travels. The coin C31 is therefore transported toward the downstream side of transport path 21 (in +y-axis direction).

Figure 13:
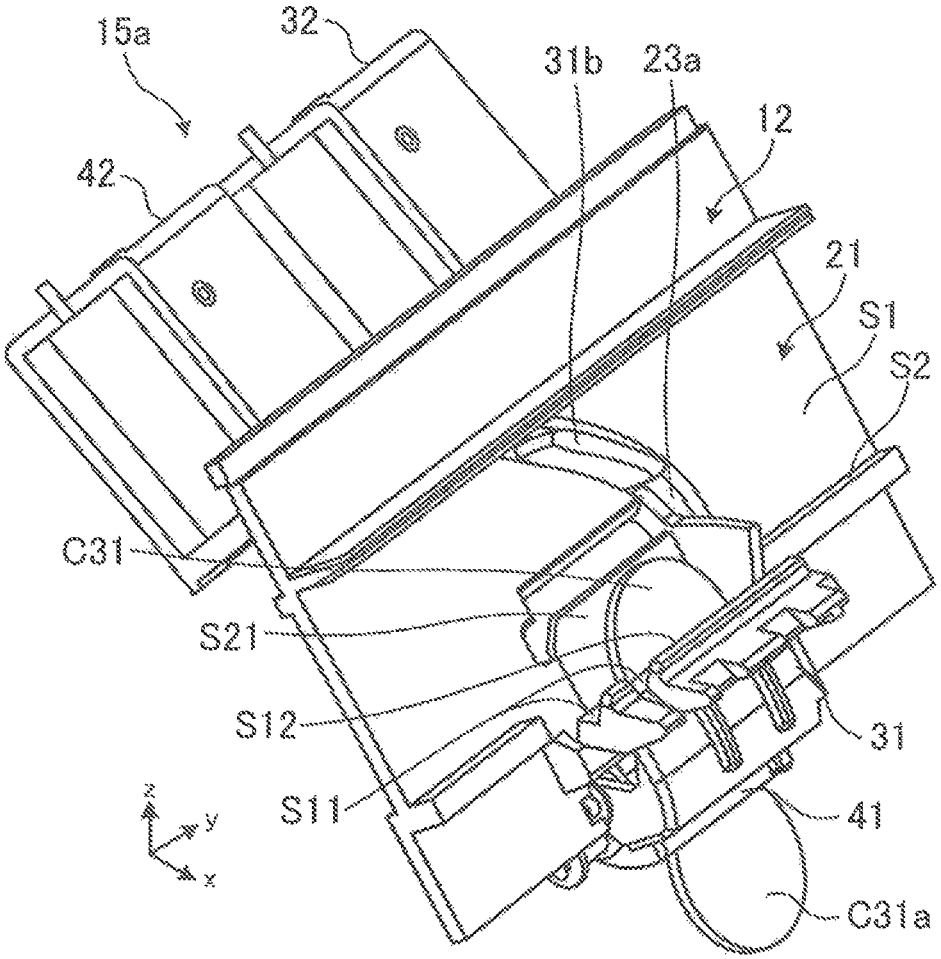
FIG. 13 is a second perspective view of the coin diverter attached to the transport unit.

FIG. 13 is a second perspective view of the coin diverter 15*a* attached to the transport unit 12. In FIG. 13, the same portions as those in FIG. 11 have the same reference characters.

The coin diverter 15*a* shown in FIG. 13 differs from the coin diverter 15*a* shown in FIG. 11 in that the A gate 31 has pivoted around the shaft 31*a*, which serves as the axis of pivotal motion. Specifically, the A gate 31 has pivoted clockwise around the shaft 31*a*, which serves as the axis of pivotal motion. On the other hand, the B gate 41 has not changed from the state shown in FIG. 11.

The bottom surface S11 of the A gate 31 is not flush with the bottom surface S2 of the transport path 21, as shown in FIG. 13. That is, the A gate 31 forms an opening (first opening) in the bottom surface of the transport path 21 in the state shown in FIG. 13.

The coin C31 therefore drops through the space between the A gate 31 and the B gate 41, as indicated by a coin C31*a* in FIG. 13. The coin C31*a* having dropped through the space between the A gate 31 and the B gate 41 is stored in the storing/feeding unit 16*a* shown in FIG. 5.

The coin C31*a* travels, for example, along a chute (not shown in FIG. 5 or 13) connected to the storing/feeding unit 16*a* and is stored in the storing/feeding unit 16*a*.

The guide 31*b* of the A gate 31 protrudes beyond the side surface S1 of the transport path 21 in response to the pivotal motion of the A gate 31, as shown in FIG. 13. The coin C31 is thus not allowed to travel in the downstream transport direction. The coin C31 therefore reliably drops through the space between the A gate 31 and the B gate 41. The guide 31*b* of the A gate 31 prevents the coin C31 from being transported toward the downstream side of the transport path 21 and forms a first guide that leads the coin C31 to the first opening.

Figure 14:
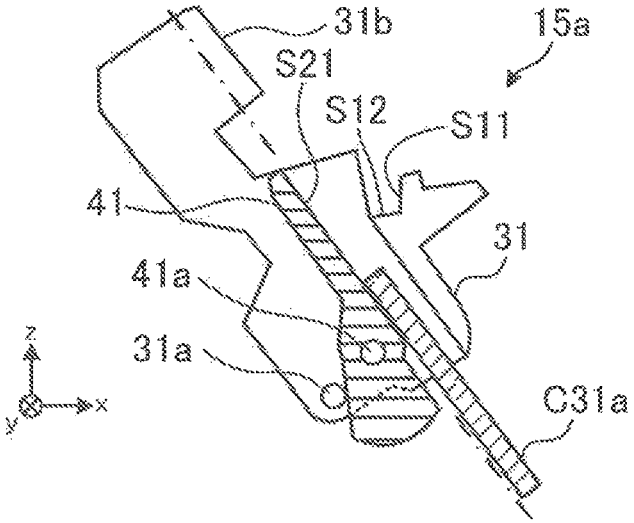
FIG. 14 shows the coin diverter in the state in FIG. 13 viewed along the −y-axis direction.

FIG. 14 shows the coin diverter 15*a* in the state in FIG. 13 viewed along the −y-axis direction. In FIG. 14, the same portions as those in FIG. 12 have the same reference characters.

The A gate 31 shown in FIG. 14 has pivoted clockwise around the shaft 31*a*, which serves as the axis of pivotal motion, with respect to the A gate 31 shown in FIG. 12. On the other hand, the B gate 41 has not pivoted from the state shown in FIG. 12.

As a result, the bottom surface S11 of the A gate 31 is not flush with the bottom surface S2 of the transport path 21, and a bottom portion (first opening) of the opening section 23*a* of the transport path 21 is therefore unblocked. The coin C31*a* slides along the side surface S21 of the B gate 41 and drops through the first opening, as shown in FIG. 14. The coin C31*a* having slid along the side surface S21 of the B gate 41 and dropped through the first opening travels along the chute connected to the storing/feeding unit 16*a* and is stored in the storing/feeding unit 16*a*, as described above.

The guide 31*b* of the A gate 31 protrudes beyond the side surface S1 of the transport path 21 (chain line shown in FIG. 14) in response to the clockwise pivotal motion of the A gate 31. The coin C31*a* is thus not allowed to travel in the downstream transport direction, as described above, reliably slides along the side surface S21 of the B gate 41, and drops through the first opening.

Figure 15:
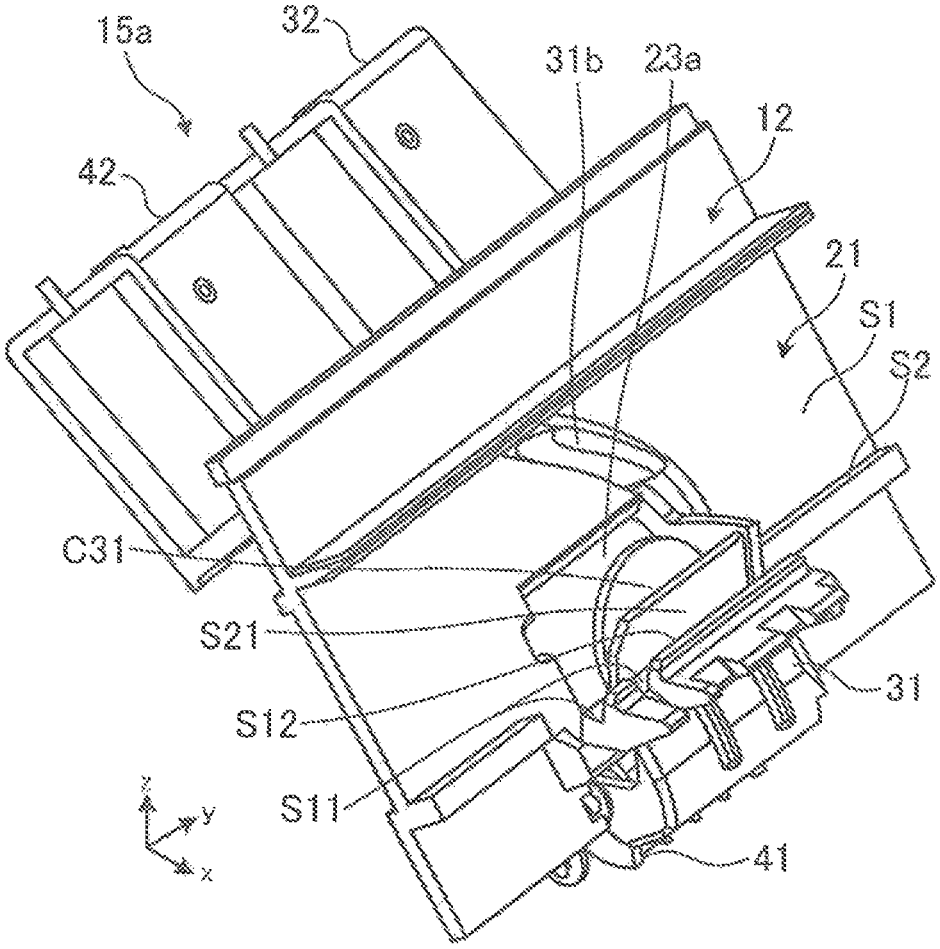
FIG. 15 is a third perspective view of the coin diverter attached to the transport unit.

FIG. 15 is a third perspective view of the coin diverter 15*a* attached to the transport unit 12. In FIG. 15, the same portions as those in FIG. 11 have the same reference characters.

The coin diverter 15*a* shown in FIG. 15 differs from the coin diverter 15*a* shown in FIG. 13 in that the B gate 41 has pivoted around the shaft 41*a*, which serves as the axis of pivotal motion. Specifically, the B gate 41 has pivoted clockwise around the shaft 41*a*, which serves as the axis of pivotal motion. On the other hand, the A gate 31 has not changed from the state shown in FIG. 13.

The bottom surface S21 of the B gate 41 is not flush with the side surface S1 of the transport path 21, as shown in FIG. 15. Specifically, the side surface S21 of the B gate 41 protrudes beyond the side surface S1 of the transport path 21 and therefore forms an opening (second opening) in the side surface S1 of the transport path 21.

The coin C31 therefore drops along the side facing the rear surface of the B gate 41 (side opposite side surface S21, rear side of side surface S21), as shown in FIG. 15. The coin C31 having dropped along the side facing the rear surface of the B gate 41 is stored in the storing/feeding unit 16*e* shown in FIG. 5.

The coin C31 travels, for example, along a chute (not shown in FIG. 5 or 15) connected to the storing/feeding unit 16*e* and is stored in the storing/feeding unit 16*e*.

The guide 31*b* of the A gate 31 protrudes beyond the side surface S1 of the transport path 21, as shown in FIG. 15. The coin C31 is thus not allowed to travel in the downstream transport direction. The coin C31 therefore reliably drops along the side facing the rear surface of the B gate 41. The guide 31*b* of the A gate 31 prevents the coin C31 from being transported toward the downstream side of the transport path 21 and forms a second guide that leads the coin C31 to the second opening.

Figure 16:
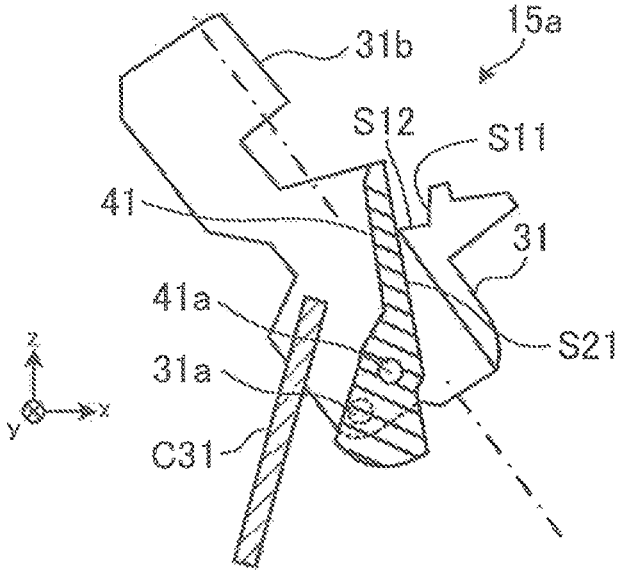
FIG. 16 shows the coin diverter in the state in FIG. 15 viewed along the −y-axis direction.

FIG. 16 shows the coin diverter 15*a* in the state in FIG. 15 viewed along the −y-axis direction. In FIG. 16, the same portions as those in FIG. 14 have the same reference characters.

The B gate 41 shown in FIG. 16 has pivoted clockwise around the shaft 41*a*, which serves as the axis of pivotal motion, with respect to the B gate 41 shown in FIG. 14. On the other hand, the A gate 31 has not pivoted from the state shown in FIG. 14.

As a result, the side surface S21 of the B gate 41 is not flush with the side surface S1 of the transport path 21, and a side portion (second opening) of the opening section 23*a* of the transport path 21 is therefore unblocked. The coin C31 passes through the second opening and drops along the side facing the rear surface of the B gate 41, as shown in FIG. 16. The coin C31 having dropped along the side facing the rear surface of the B gate 41 travels along the chute connected to the storing/feeding unit 16*e* and is stored in the storing/feeding unit 16*e*, as described above.

The guide 31*b* of the A gate 31 protrudes beyond the side surface S1 of the transport path 21 (chain line shown in FIG. 16) in the state shown in FIG. 16. The coin C31 is thus not allowed to travel in the downstream transport direction, as described above, passes through the second opening, and reliably drops along the side facing the rear surface of the B gate 41.

Actions of the actuators 32 and 42 will be described. The state of the coin diverter 15*a* shown in FIGS. 11 and 12, in which a coin is transported in the downstream transport direction, is called a first state. The state of the coin diverter 15*a* shown in FIGS. 13 and 14, in which a coin drops through the opening formed in the bottom surface S2 of the transport path 21, is called a second state. The state of the coin diverter 15*a* shown in FIGS. 15 and 16, in which a coin drops through the opening formed in the side surface S1 of the transport path 21, is called a third state.

First, it is assumed that the coin diverter 15*a* operates in the first state. To cause the coin diverter 15*a* to transition from the first state to the second state, the actuator 32 causes the A gate 31 to pivot. For example, the actuator 32 causes the A gate 31 to pivot clockwise around the shaft 31*a*, which serves as the axis of pivotal motion, as shown in FIG. 14.

To cause the coin diverter 15*a* to transition from the second state to the third state, the actuator 42 causes the B gate 41 to pivot. For example, the actuator 42 causes the B gate 41 to pivot clockwise around the shaft 41*a*, which serves a as the axis of pivotal motion, as shown in FIG. 16.

To cause the coin diverter 15*a* to transition from the first state to the third state, the actuators 32 and 42 cause the A gate 31 and the B gate 41 to pivot. For example, the actuator 32 causes the A gate 31 to pivot clockwise around the shaft 31*a*, which serves as the axis of pivotal motion, and the actuator 42 causes the B gate 41 to pivot clockwise around the shaft 41*a*, which serves as the axis of pivotal motion, as shown in FIG. 16.

The actuators 32 and 42 can, of course, cause the coin diverter 15*a* to transition from a state to another state other than the cases described above. For example, the actuators 32 and 42 can cause the coin diverter 15*a* to transition from the third state to the second state and from the third state to the first state.

As described above, the coin diverter 15*a* includes the A gate 31 and the B gate 41, which divert a coin from the transport path 21. The coin diverter 15*a* further includes the actuators 32 and 42, which change the state of the A gate 31 and the B gate 41 to any of the first state, in which the A gate 31 and the B gate 41 lead the coin toward the downstream side of the transport path 21, the second state, in which the A gate 31 and the B gate 41 lead the coin in a first direction in which the coin drops from the transport path 21, and the third state, in which the A gate 31 and the B gate 41 lead the coin in a second direction different from the direction toward the downstream side of the transport path 21 and the first direction. The thus configured coin diverter 15*a* is a single apparatus (module) that diverts a coin in the three directions, whereby the size of the coin handling apparatus can be reduced.

Embodiment 2

In Embodiment 2, a coin is diverted in four directions.

Figure 17:
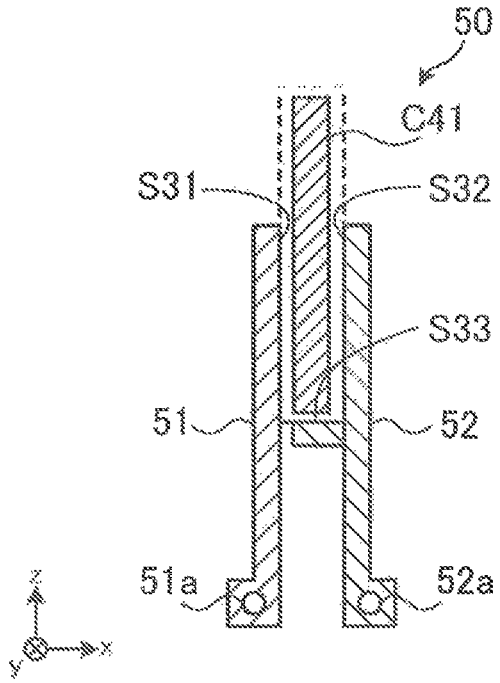
FIG. 17 is a front cross-sectional view showing an example of a coin diverter according to Embodiment 2.

FIG. 17 is a front cross-sectional view showing an example of a coin diverter 50 according to Embodiment 2. The coin diverter 50 includes an A gate 51 and a B gate 52, as shown in FIG. 17. In the following description, a three-axis coordinate system, such as that shown in FIG. 17, is set in relation to the coin diverter 50.

In FIG. 17, a transport path extends in the direction perpendicular to the plane of FIG. 17 (y-axis direction). The dotted line shown in FIG. 17 represents the cross-sectional shape of the transport path.

FIG. 17 shows a coin C41. The coin C41 is transported along the transport path in the +y-axis direction.

Figure 22:
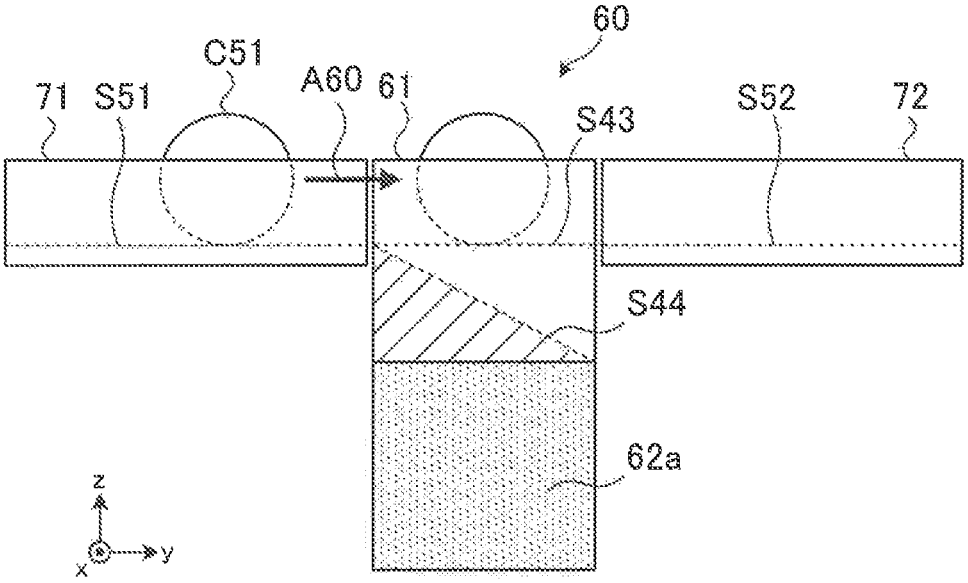
FIG. 22 shows the coin diverter in the state shown in FIG. 21 viewed along the +x-axis direction.

The A gate 51 and the B gate 52 are provided in the middle of the transport path (provided, for example, between transport paths 71 and 72, as shown in FIG. 22). The A gate 51 pivots around a shaft 51*a*, which extends in the y-axis direction and serves as the axis of pivotal motion. The A gate 51 has a side surface S31.

The B gate 52 pivots around a shaft 52*a*, which extends in the y-axis direction and serves as the axis of pivotal motion. The B gate has a side surface S32 and a bottom surface S33. The side surface S32 and the bottom surface S33 form an L-letter-shaped surface.

When the coin diverter 50 operates in the state shown in FIG. 17, the side surface S31 of the A gate 51 forms a side surface of the transport path. For example, the side surface S31 forms a left side surface of the transport path indicated by the dotted line.

When the coin diverter 50 operates in the state shown in FIG. 17, the side surface S32 of the B gate 52 forms a side surface of the transport path, and the bottom surface S33 forms the bottom surface of the transport path. For example, the side surface S32 forms a right-side surface of the transport path indicated by the dotted line, and the bottom surface S33 forms the bottom surface of the transport path indicated by the dotted line. The coin C41 is thus transported toward the downstream side of the transport path (in +y-axis direction).

Although not shown in FIG. 17, the coin diverter 50 includes an actuator that causes the A gate 51 to pivot and an actuator that causes the B gate 52 to pivot.

Figure 18:
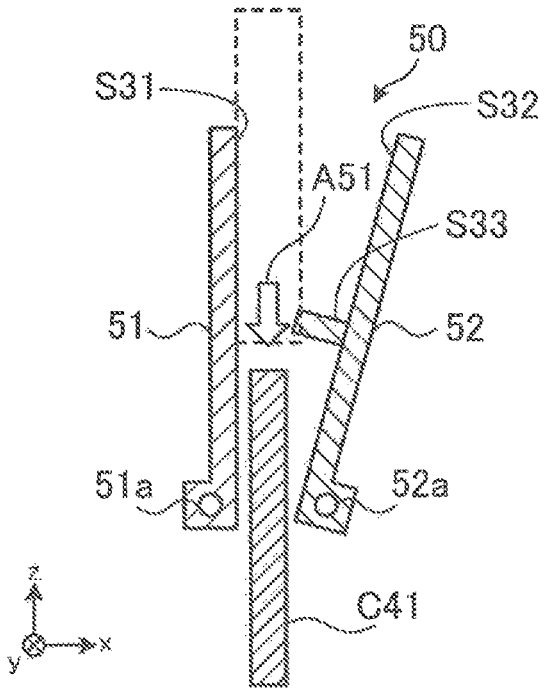
FIG. 18 is a front cross-sectional view of the coin diverter.

FIG. 18 is a front cross-sectional view of the coin diverter 50. In FIG. 18, the same portions as those in FIG. 17 have the same reference characters.

The B gate 52 shown in FIG. 18 has pivoted clockwise around the shaft 52*a*, which serves as the axis of pivotal motion, with respect to the B gate 52 shown in FIG. 17. The pivotal motion of the B gate 52 causes the bottom surface S33 of the B gate 52 to be separate from the bottom surface of the transport path, whereby an opening is formed in the bottom surface of the transport path. The coin C41 therefore drops downward, as indicated by the arrow A51.

Figure 19:
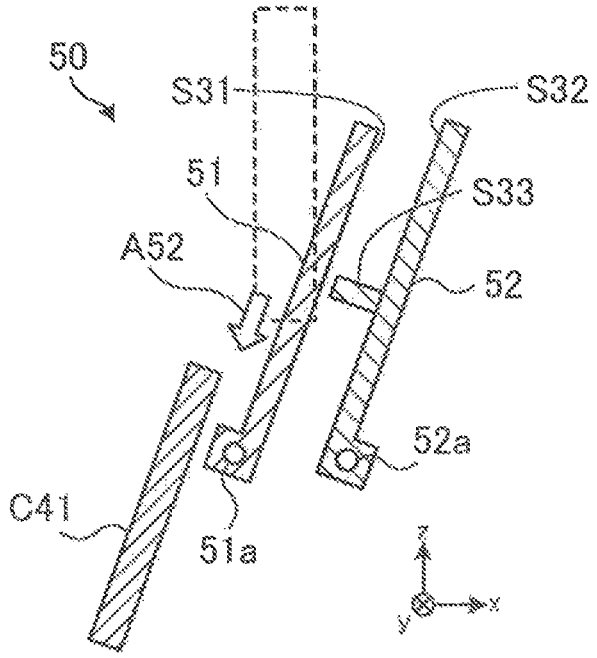
FIG. 19 is a front cross-sectional view of the coin diverter.

FIG. 19 is a front cross-sectional view of the coin diverter 50. In FIG. 19, the same portions as those in FIG. 17 have the same reference characters.

The A gate 51 shown in FIG. 19 has pivoted clockwise around the shaft 51*a*, which serves as the axis of pivotal motion, with respect to the A gate 51 shown in FIG. 17. The B gate 52 shown in FIG. 19 has pivoted clockwise around the shaft 52*a*, which serves as the axis of pivotal motion, with respect to the B gate 52 shown in FIG. 17. The pivotal motion of the A gate 51 and the B gate 52 causes the side surface S31 of the A gate 51 and the side surface S32 of the B gate 52 to be separate from the side surfaces of the transport path, whereby an opening is formed on the rear side of the side surface S31 of the A gate 51 (side opposite side surface S31, rear side of side surface S31).

The coin C41 therefore drops toward the left side surface of the transport path, as indicated by the arrow A52. That is, the coin C41 drops in a direction different from the direction indicated by the arrow A51 in FIG. 18.

Figure 20:
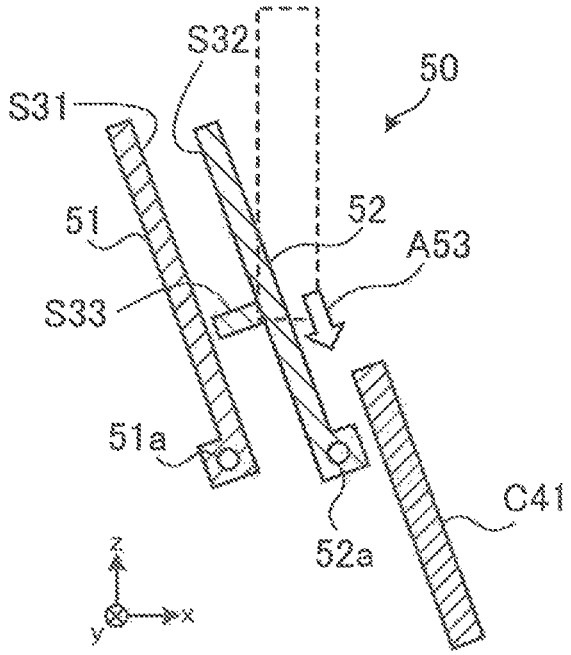
FIG. 20 is a front cross-sectional view of the coin diverter.

FIG. 20 is a front cross-sectional view of the coin diverter 50. In FIG. 20, the same portions as those in FIG. 17 have the same reference characters.

The A gate 51 shown in FIG. 20 has pivoted counterclockwise around the shaft 51*a*, which serves as the axis of pivotal motion, with respect to the A gate 51 shown in FIG. 17. The B gate 52 shown in FIG. 20 has pivoted counterclockwise around the shaft 52*a*, which serves as the axis of pivotal motion, with respect to the B gate 52 shown in FIG. 17. The pivotal motion of the A gate 51 and the B gate 52 causes the side surface S31 of the A gate 51 and the side surface S32 of the B gate 52 to be separate from the side surfaces of the transport path, whereby an opening is formed on the rear side of the side surface S32 of the B gate 52 (side opposite side surface S32, rear side of side surface S32).

The coin C41 therefore drops toward the right-side surface of the transport path, as indicated by the arrow A53. That is, the coin C41 drops in a direction different from the direction indicated by the arrow A51 in FIG. 18 and the direction indicated by the arrow A52 in FIG. 19.

The A gate 51 and the B gate 52 have four states. For example, the A gate 51 and the B gate 52 have the state in which the coin C41 is transported in the downstream transport direction (first state), as shown in FIG. 17. The A gate 51 and the B gate 52 further have the state in which the coin C41 drops downward (second state), as shown in FIG. 18. The A gate 51 and the B gate 52 further have the state in which the coin C41 drops toward the left side surface (third state), as shown in FIG. 19. The A gate 51 and the B gate 52 further have the state in which the coin C41 drops toward the right-side surface (fourth state), as shown in FIG. 20.

The actuators cause the A gate 51 and the B gate 52 to transition to any of the four states described above. The coin diverter 50 can thus divert the coin C41 in the four directions.

As described above, the coin diverter 50 includes the A gate 51 and the B gate 52, which divert a coin from the transport path. The coin diverter 50 further includes the actuators that change the state of the A gate 51 and the B gate 52 to any of the state in which the coin C41 is led in the downstream transport direction, the state in which the coin C41 is led downward, the state in which the coin C41 is led toward the left side surface of the transport path, and the state in which the coin C41 is led toward the right side surface of the transport path. The thus configured coin diverter 50 is a single apparatus that diverts a coin in the four directions, whereby the size of the coin handling apparatus can be reduced.

The transport path may instead be a transport path that inclines obliquely downward in the +y-axis direction. In this case, the coin C41 is transported while rolling on the transport path and diverted from the transport path by the coin diverter 50. The transport path may still instead transport the coin C41 with the aid of a known transport mechanism that does not prevent the coin C41 from dropping downward from the transport path, toward the left side surface thereof, or toward the right-side surface thereof.

Embodiment 3

In Embodiment 3, a coin is diverted in the four directions in a method different from the method used in Embodiment 2.

Figure 21:
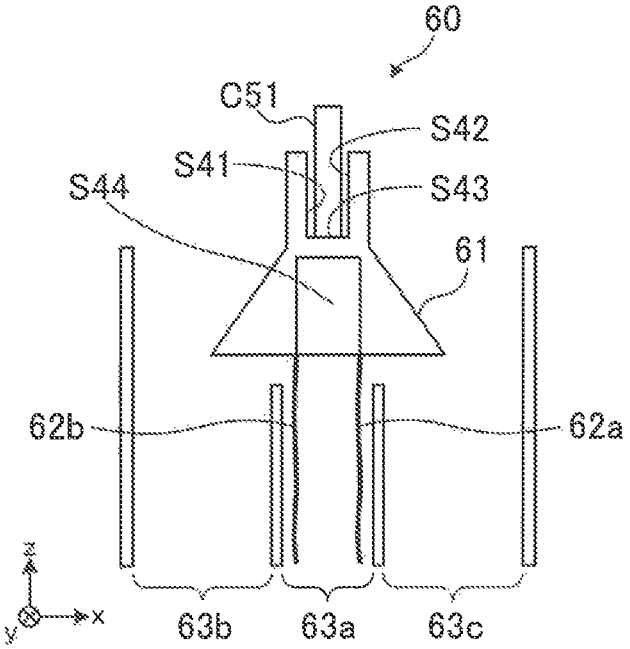
FIG. 21 is a front view of an example of a coin diverter according to Embodiment 3.

FIG. 21 is a front view of an example of a coin diverter 60 according to Embodiment 3. The coin diverter 60 includes a gate 61 and chute guides 62*a* and 62*b*, as shown in FIG. 21. In the following description, a three-axis coordinate system, such as that shown in FIG. 21, is set in relation to the coin diverter 60.

FIG. 21 further shows chutes 63*a* to 63*c* in addition to the coin diverter 60. The chutes 63*a* to 63*c* are connected to three storing/feeding units (not shown). FIG. 21 further shows a coin C51.

The gate 61 has side surfaces S41 and S42 and a bottom surface S43. The side surfaces S41 and S42 and the bottom surface S43 form a U-letter-shaped surface.

In FIG. 21, a transport path extends in the direction perpendicular to the plane of FIG. 21 (in y-axis direction). When the coin diverter 60 operates in the state shown in FIG. 21, the side surfaces S41 and S42 and the bottom surface S43 of the gate 61 form the side surfaces and the bottom surface of the transport path (see FIG. 22, for example).

The gate 61 is so shaped that part of the upstream surface in the transport direction and part of the bottom surface are cut (see hatched portion in FIG. 22, for example). The gate 61 has a guide surface S44 in the cut portion, and the guide surface 44 is a flat inclining surface that prevents the coin C51 from traveling in the +y-axis direction (see FIG. 24, for example). The guide surface S44 inclines downward in the direction toward the positive side of the y-axis direction.

One end of each of the chute guides 62*a* and 62*b* is connected to the bottom surface of the gate 61. The chute guides 62*a* and 62*b* are each formed, for example, of a flexible film made, for example, of a synthetic resin. The other end of each of the chute guides 62*a* and 62*b* that is not connected to the gate 61 is accommodated in the chute 63*a*.

Figure 25:
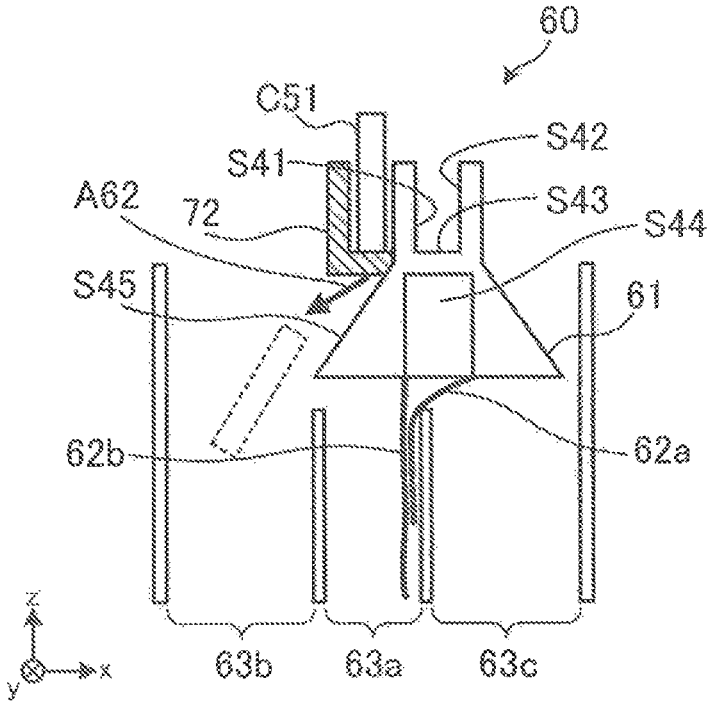
FIG. 25 shows a state in which the gate has moved rightward.
Figure 26:
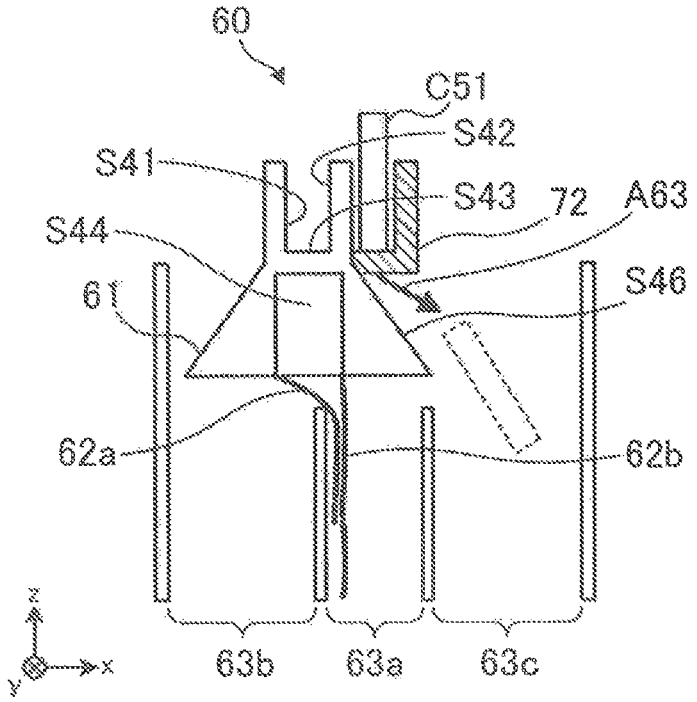
FIG. 26 shows a state in which the gate has moved leftward.

The gate 61 moves rightward and leftward in FIG. 21 (see FIGS. 25 and 26, for example). Although not shown in FIG. 21, the coin diverter 60 includes an actuator that moves the gate 61 rightward and leftward.

FIG. 22 shows the coin diverter 60 in the state shown in FIG. 21 and viewed along the +x-axis direction. In FIG. 22, the same portions as those in FIG. 21 have the same reference characters.

FIG. 22 shows transport paths 71 and 72. The coin diverter 60 is provided between the transport paths 71 and 72. The hatched portion of the gate 61 is a cut, hollow portion.

In the state shown in FIG. 22, a bottom surface SM of the transport path 71 and the bottom surface S43 of the gate 61 are flush with each other. A bottom surface S52 of the transport path 72 and the bottom surface S43 of the gate 61 are flush with each other.

The coin C51 is therefore transported from the transport path 71 to the transport path 72, as indicated by the arrow A60. That is, the coin CM is transported downstream (in +y-axis direction) in the transport paths 71 and 72.

Figure 23:
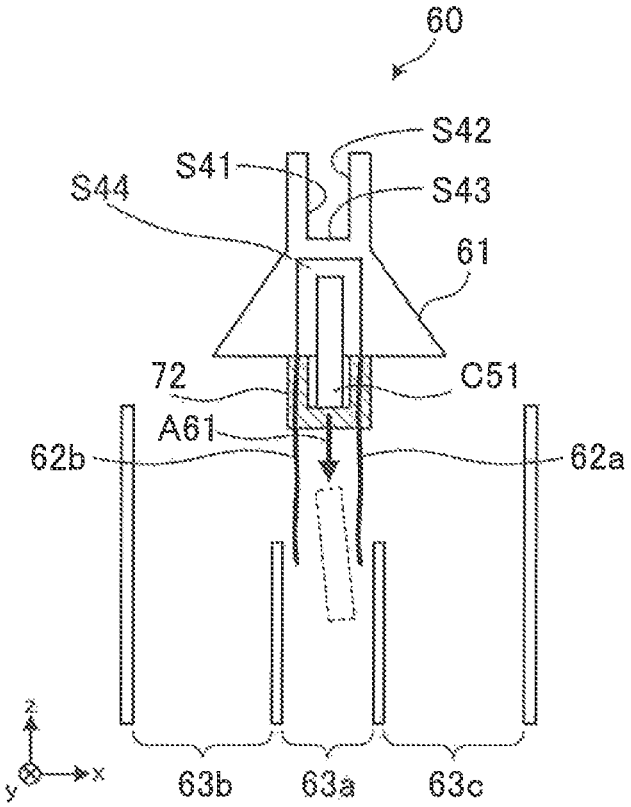
FIG. 23 shows a state in which a gate has moved upward.

FIG. 23 shows a state in which the gate 61 has moved upward. In FIG. 23, the same portions as those in FIG. 21 have the same reference characters. FIG. 23 further shows the transport path 72 shown in FIG. 22. The gate 61 shown in FIG. 23 has moved upward (in +z-axis direction) with respect to the gate shown in FIG. 21.

Figure 24:
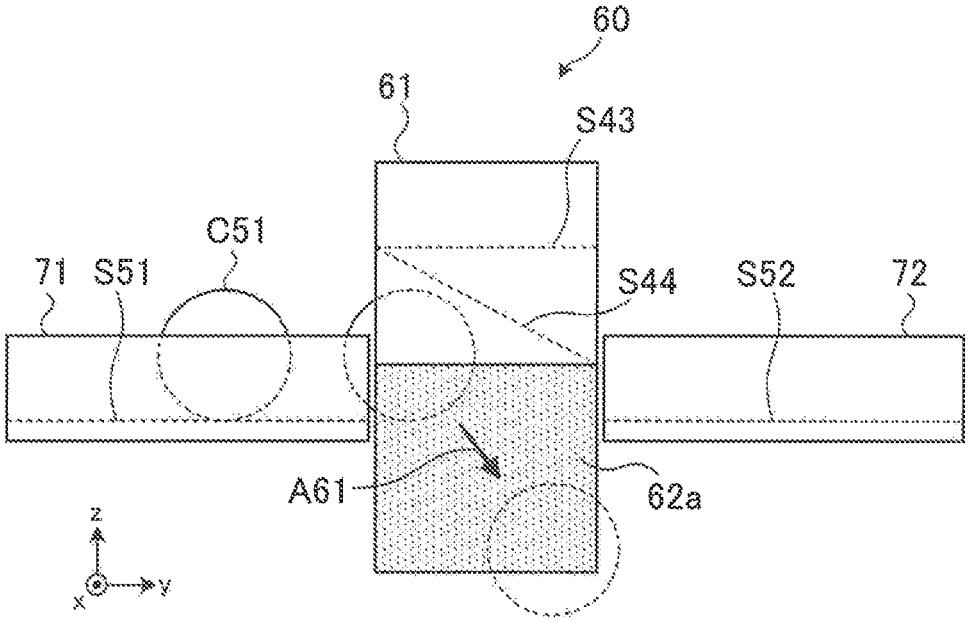
FIG. 24 shows the coin diverter in the state shown in FIG. 23 viewed along the +x-axis direction.

FIG. 24 shows the coin diverter 60 in the state shown in FIG. 23 viewed along the +x-axis direction. In FIG. 23, the same portions as those in FIGS. 21, 22, and 23 have the same reference characters.

When the gate 61 moves upward, the bottom surface S43 also moves upward. The bottom surface S43 formed by the gate 61 is not present between the transport paths 71 and 72, whereby an opening is formed. Instead, the guide surface S44 formed in the gate 61 is present in the direction in which the coin C51 is transported (+y-axis direction). The guide surface S44 prevents the coin C51 from being transported in the downstream transport direction.

That is, when the gate 61 moves upward, the coin CM drops downward, as indicated by the arrow A61. The dropping coins CM drops into the chute 63*a*, as shown in FIG. 23.

The chute guides 62*a* and 62*b*, which are provided on the bottom surface of the gate 61, extend into the chute 63*a*, as shown in FIG. 23. Therefore, even when the gate 61 moves upward and the distance between the gate 61 and the chute 63*a* increases accordingly, a situation in which the coin C51 drops into the other chute 63*b* or 63*c* can be avoided.

FIG. 25 shows a state in which the gate 61 has moved rightward. In FIG. 25, the same portions as those in FIG. 21 have the same reference characters. FIG. 25 further shows the transport path 72 shown in FIG. 22. The gate 61 shown in FIG. 25 has moved rightward (in +x-axis direction) with respect to the gate 61 shown in FIG. 21.

When the gate 61 moves rightward, the transport path formed by the side surfaces S41 and S42 and the bottom surface S43 of the gate 61 is shifted rightward relative to the transport paths 71 and 72. The coin C51 transported along the transport path 71 therefore drops along the side facing a left side surface S45 of the gate 61 and then into the chute 63*b*, as indicated by the arrow A62.

The left side surface S45 of the gate 61 inclines in such a way that the root portion of the gate 61 widens downward. The reason for this is that the dropping coin C51 drops into the chute 63*b* but does not drop into the chute 63*a*.

FIG. 26 shows a state in which the gate 61 has moved leftward. In FIG. 26, the same portions as those in FIG. 21 have the same reference characters. FIG. 26 further shows the transport path 72 shown in FIG. 22. The gate 61 shown in FIG. 26 has moved leftward (in −x-axis direction) with respect to the gate 61 shown in FIG. 21.

When the gate 61 moves leftward, the transport path formed by the side surfaces S41 and S42 and the bottom surface S43 of the gate 61 is shifted leftward relative to the transport paths 71 and 72. The coin C51 transported along the transport path 71 therefore drops along the side facing a right side surface S46 of the gate 61 and then into the chute 63*c*, as indicated by the arrow A63.

The right-side surface S46 of the gate 61 inclines in such a way that the root portion of the gate 61 widens downward. The reason for this is that the dropping coin C51 drops into the chute 63*c* but does not drop into the chute 63*a*.

The gate 61 has four states. For example, the gate 61 has the state in which the gate transports the coin C51 in the downstream transport direction (first state), as shown in FIG. 21. The gate 61 further has the state in which the gate 61 drops the coin C61 downward (second state), as shown in FIG. 23. The gate 61 further has the state in which the gate 61 drops the coin C51 toward the left side surface of the transport path (third state), as shown in FIG. 25. The gate 61 further has the state in which the gate 61 drops the coin C51 toward the right-side surface of the transport path (fourth state), as shown in FIG. 26.

The actuator causes the state of the gate 61 to transition to any of the four states described above. The coin diverter 60 can therefore divert the coin C51 in the four directions.

As described above, the coin diverter 60 includes the gate 61, which diverts a coin from the transport paths 71 and 72. The coin diverter 60 further includes the actuator that changes the state of the gate 61 to any of the state in which the gate 61 leads the coin C51 in the downstream transport direction, the state in which the gate 61 leads the coin C61 downward, the state in which the gate 61 leads the coin C51 toward the left side surface of the transport path, and the state in which the gate 61 leads the coin C51 toward the right side surface of the transport path. The thus configured coin diverter 60 is a single apparatus that diverts a coin in the four directions, whereby the size of the coin handling apparatus can be reduced.

The transport path may instead be a transport path that inclines obliquely downward in the +y-axis direction. In this case, the coin C41 is transported while rolling on the transport path and diverted from the transport path by the coin diverter 60.

In the above description, the chute guides 62*a* and 62*b* are each formed of a film and may instead be formed of a rigid plate-shaped member having a comb-tooth shape. In this case, an upper portion of the chute 63*a* is also formed in a comb-tooth shape. For example, lower portions of the chute guides 62*a* and 62*b* that are each a plate-shaped member and an upper portion of the chute 63*a* are each formed in a comb-tooth shape so that the lower portions of the chute guides 62*a* and 62*b* that are each a plate-shaped member and the upper portion of the chute 63*a* do not come into contact with each other when the gate 61 moves rightward or leftward as shown in FIGS. 25 and 26.

REFERENCE SIGNS LIST

1 Coin handling apparatus
2 Inlet
3 Outlet
11 Accumulating/feeding unit
12 Transport unit
13 Identifying unit
14, 15*a* to 15*d*, 50, 60 Coin diverter
16*a* to 16*e* Storing/feeding unit
17 Withdrawal transport unit
18 Collection box
21 Transport path
22, 23*a* to 23*d* Opening section
24 Belt
24*a* Protrusion
31, 51 A gate
32, 42 Actuator
41, 52 B gate
S1, S12, S21, S31, S32, S41, S42 Side surface
S2, S11, S33, S43 Bottom surface
61 Gate
62*a*, 62*b* Chute guide
63*a* to 63*c* Chute

The invention claimed is:

1. A coin diverter that diverts a coin transport direction, comprising:

a first member that pivots and forms a bottom surface and a first side surface of a transport path, the first member being provided to guide a coin in contact with the bottom surface to a downstream direction of the transport path;

a second member that pivots and forms a second side surface, facing to the first side surface, of the transport path; and a driver that diverts the coin transport direction in a total of three or more directions, including the downstream direction and at least two directions different from the downstream direction, by moving the first member and the second member.

2. The coin diverter according to claim 1, wherein the driver forms a first opening, through which the coin passes, between the first member and the second member by moving the first member.

3. The coin diverter according to claim 1, wherein the driver forms a second opening, through which the coin passes, on a side opposite to the first member with respect to the second member by moving the first member and the second member in a direction from the second surface to the first surface.

4. The coin diverter according to claim 1, wherein the driver forms a third opening, through which the coin passes, on a side opposite to the second member with respect to the first member by moving the first member and the second member in a direction from the first surface to the second surface.

5. The coin diverter according to claim 1, wherein the first member includes a guide which protrudes beyond the second surface when the first member pivots, and the guide prevents the coin from being transported in the downstream direction of the transport path by protruding beyond the second surface.

6. The coin diverter according to claim 1, wherein the driver comprises a first actuator that drives the first member and a second actuator that drives the second member.

7. The coin diverter according to claim 1, wherein the first member and the second member are provided at a same position of the transport path.

* * * * *